United States Patent [19]

Takahashi

[11] 4,397,277

[45] Aug. 9, 1983

[54] CENTRIFUGAL GOVERNOR FOR INTERNAL COMBUSTION ENGINES, HAVING A FUNCTION OF RELEASING ADAPTATION MEANS

[75] Inventor: Masaatsu Takahashi, Higashi-Matsuyama, Japan

[73] Assignee: Diesel Kiki Co., Ltd., Tokyo, Japan

[21] Appl. No.: 317,470

[22] Filed: Nov. 2, 1981

[30] Foreign Application Priority Data

Nov. 11, 1980 [JP] Japan ..... 55-159028

[51] Int. Cl.[3] ..... F02D 1/04

[52] U.S. Cl. ..... 123/373; 123/368; 123/364

[58] Field of Search ..... 123/373, 372, 370, 371, 123/368, 365, 364, 374

[56] References Cited

U.S. PATENT DOCUMENTS

| | | | |
|---|---|---|---|
| 3,659,570 | 5/1972 | Yoshino | 123/373 |
| 3,672,343 | 6/1972 | Biechl | 123/364 |
| 3,791,362 | 2/1974 | Nakamura | 123/365 |
| 4,286,558 | 9/1981 | Djordsjeuic | 123/374 |
| 4,313,409 | 2/1982 | Makino | 123/373 |

FOREIGN PATENT DOCUMENTS

| | | | |
|---|---|---|---|
| 2536247 | 2/1976 | Fed. Rep. of Germany | 123/373 |
| 2802934 | 7/1978 | Fed. Rep. of Germany | 123/374 |
| 54-39723 | 3/1979 | Japan | 123/365 |

*Primary Examiner*—Charles J. Myhre
*Assistant Examiner*—Carl Stuart Miller
*Attorney, Agent, or Firm*—Frishauf, Holtz, Goodman & Woodward

[57] ABSTRACT

In a centrifugal governor for use with an internal combustion engine, means is provided which is adapted to bring an adjusting member into urging contact with a fuel quantity increasing lever engaging the guide lever and the floating lever only at engine full load in medium and high engine speed ranges, whereby contraction of the adaptation spring causes angular displacement of the fuel quantity increasing lever in the fuel quantity increasing direction. Stopper means may also be provided which is adapted to be in urging contact with the fuel quantity increasing lever in the medium and high engine speed ranges to prohibit angular displacement of the fuel quantity increasing lever in the fuel quantity decreasing direction which is caused by the contraction of the adaptation spring, when the adjusting member is positioned off the fuel quantity increasing lever at engine partial load.

7 Claims, 7 Drawing Figures

CENTRIFUGAL GOVERNOR FOR INTERNAL COMBUSTION ENGINES, HAVING A FUNCTION OF RELEASING ADAPTATION MEANS

BACKGROUND OF THE INVENTION

This invention relates to a centrifugal governor for use with an internal combustion engine, and more particularly to means for releasing the adaptation mechanism of the centrifugal governor at partial load operation of the engine.

A conventional centrifugal governor for internal combustion engines is generally provided with an adaptation mechanism (plus adaptation mechanism) which is adapted to cause displacement of the control rack in a fuel quantity decreasing direction in medium and high engine speed ranges to increase the output torque of the engine in the same ranges.

A centrifugal governor is already known which is equipped with an adaptation mechanism which comprises an adaptation spring arranged to counteract displacement of flyweights in a fuel quantity decreasing direction; a supporting lever engaging at its intermediate portion with a control lever which is manually operatable, at its one end with a tension lever biased in a fuel quantity increasing direction by a control spring, and at its other end with a floating lever engaging with the control rack, respectively; a fuel quantity increasing lever engaging at its one end with a guide lever connected between a shifter movable with the flyweights and the tension lever, and at its other end with the floating lever, respectively; and an adjusting member carried by the tension lever with its one end disposed for urging contact with an intermediate portion of the fuel quantity increasing lever. When the engine rotational speed exceeds a predetermined value, the adjusting member comes into urging contact with the fuel quantity increasing lever as the shifter is moved in the fuel quantity decreasing direction. Further movement of the shifter causes contraction of the adaptation spring, which in turn causes angular displacement of the fuel quantity increasing lever in the fuel quantity increasing direction.

In the above-mentioned type adaptation mechanism, the adjusting member is held stationary at a preset position on the tension lever, and is disposed for urging contact with the fuel quantity increasing lever in dependence on the angular position of the supporting lever and the position of the shifter. Thus, the adaptation mechanism acts to increase the fuel injection quantity not only at engine full load but also at engine partial load in medium and high engine speed ranges, which involves the following problems:

(1) In the medium and high engine speed ranges where the fuel injection quantity increases due to the action of the adaptation mechanism, the actual output torque of the engine exceeds a required value corresponding to actual load on the engine. Therefore, even slight stepping-on of the accelerator pedal causes an large increase in the engine rpm, whereas it is difficult to carry out stable control of the engine rpm during constant-speed running of the vehicle.

(2) Upon transition from a low engine speed range to a medium or high engine speed range (fuel quantity-increased range), there can occur a sudden increase in the fuel injection quantity, which brings about unbalance between the increased engine speed and the actual vehicle speed, causing knocking of the vehicle.

OBJECTS AND SUMMARY OF THE INVENTION

It is an object of the invention to provide a centrifugal governor for use with an internal combustion engine, in which the adaptation mechanism is adapted to operate only at engine full load in medium and high engine speed ranges, facilitating driving of the vehicle during constant-speed running and avoiding knocking of the vehicle from a low speed range to a middle or high speed range.

It is a further object of the invention to provide a centrifugal governor for use with an internal combustion engine, in which the adaptation mechanism is adapted to operate only at engine full load in medium and high engine speed ranges, while at engine partial load, maintaining the control rack at a constant position, to enable stable control of the engine speed at engine partial load.

According to the invention, the centrifugal governor comprises means responsive to angular displacement of the supporting lever to displace the adjusting member relative to the fuel quantity increasing lever. The displacing means is adapted to bring the adjusting member into urging contact with the fuel quantity increasing lever when the engine rotational speed exceeds a predetermined value at engine full load, whereby contraction of the adaptation spring causes angular displacement of the fuel quantity increasing lever in the fuel quantity increasing direction.

Stopper means is provided which is adapted to come into urging contact with the fuel quantity increasing lever when the engine rotational speed exceeds the above predetermined value. The stopper means serves to prohibit angular displacement of the fuel quantity increasing lever in the fuel quantity decreasing direction, which is caused by the contraction of the adaptation spring, when the adjusting member is positioned off the fuel quantity increasing lever at engine partial load.

The above and other objects, features and advantages of the invention will be more apparent from the ensuing detailed description taken in connection with the accompanying drawings in which:

DETAILED DESCRIPTION

Figure 1:
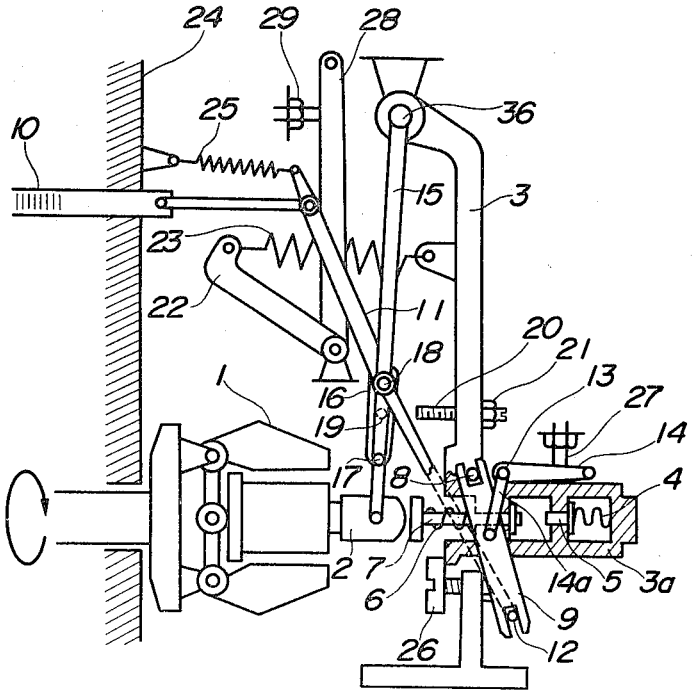
FIG. 1 PRIOR ART
FIG. 1 is a schematic view, partly in section, illustrating a conventional centrifugal governor in operating position at the start of the engine.
Figure 2:
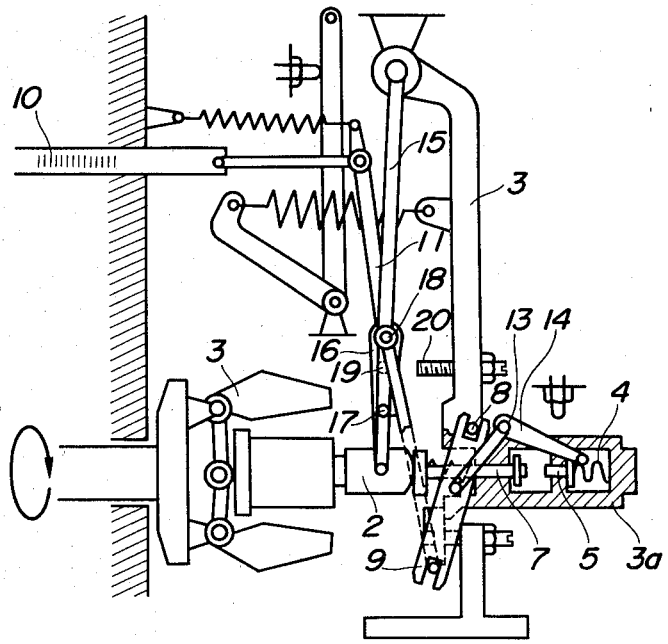
FIG. 2 PRIOR ART
FIG. 2 is a view similar to FIG. 1, illustrating the centrifugal governor of FIG. 1 in operating position at engine idle.

Referring to FIGS. 1 through 4, there is illustrated a centrifugal governor equipped with a cenventional adaptation mechanism.

Flyweights 1 are coupled to the output shaft of an engine, not shown. A shifter 2 engages the flyweights at its one end, and has its other end remote from the flyweights 1 disposed opposite a free lower end of a tension lever 3 which has another or upper end pivotally supported by a stationary shaft 36. The tension lever 3 is formed integrally with a spring casing 3*a* which has an end portion remote from the shifter in which an adaptation spring 4 is accommodated. Rods 5, 7 are slidably arranged in the spring casing 3*a*. The rod 5 is disposed to be urged by the adaptation spring 4, while the rod 7, which carries an idling spring 6 wound thereon, has one end disposed to urge the rod 5 and another opposite end disposed in urging contact with the shifter 2. A pin 8 is secured on the tension lever 3 at a location immediately above the spring casing 3*a*, which is engaged by a bifurcated end of a supporting lever 9 which has another opposite end also bifurcated and engaging a pin 12 secured on an end of a floating lever 11 which has another opposite end coupled to a control rack 10. Pivoted to an intermediate portion of the supporting lever 9 is an arm 14*a* of a control lever 14 which is pivotally supported by a stationary support shaft 13 and is manually operatable from outside. A guide lever 15 is connected between the shifter 2 and the stationary upper end of the tension lever 3. A fuel quantity increasing lever 16 has one end pivoted to a lower portion of the guide lever 15 by means of a pin 17 and another opposite end to an intermediate portion of the floating lever 11 by means of a pin 18, respectively. The fuel quantity increasing lever 16 carries a pin 19 secured on and laterally projected from its central portion. An adjusting threaded member 20 is threadedly fitted through the tension lever 3, with its one end disposed for urging contact with the pin 19. The member 20 is held at an adjusted position by means of a nut 21 fitted thereon. The tension lever 3 is pulled by a control spring 23 interposed tautly between the tension lever 3 and a swivel lever 22, to counteract the centrifugal force of the flyweights 1. The floating lever 11 is pulled by a starting spring 25 interposed tautly between the upper end of the lever 11 and the housing 24 of the governor, to urge the control rack 10 in its fuel quantity increasing direction. Incidentally, in FIG. 1, reference numeral 26 designates a full-load stopper for determining the full load fuel delivery, 27 a stopper for determining the maximum pivotable range of the control lever 14, 28 a lever for pivoting the swivel lever 22 to vary the setting load of the control spring 23 to determine the engine speed at which the governing action starts, and 29 a stopper for determining the maximum pivotable range of the lever 28, respectively.

With the above arrangement, the flyweights 1 are in closed position at the start of the engine, i.e., in the position illustrated in FIG. 1. On this occasion, the control lever 14 is pivotally rotated to an extreme position corresponding to the maximum injection quantity where it is in contact with the stopper 27 as shown in FIG. 1. Then, the starting spring 25 and the idling spring 6 act to cause displacement of the control rack 10 over a full load position to a position corresponding to the maximum injection quantity to thus obtain an increased fuel injection quantity required for starting the engine. After the engine has started, the control level 14 is clockwise rotated to a position shown in FIG. 2, and the supporting lever 9 is accordingly clockwise rotated about the pin 8 on the tension lever 3 to cause clockwise rotation of the floating lever 11 about the pin 18 to urgingly displace the control rack 10 in its fuel quantity decreasing direction (in the rightward direction as viewed in the drawing). At this position, the flyweights 1, the idling spring 6 and the starting spring 25 are placed in a well balanced state with the control rack 10 held at a constant position, to carry out smooth idling operation of the engine.

Figure 3:
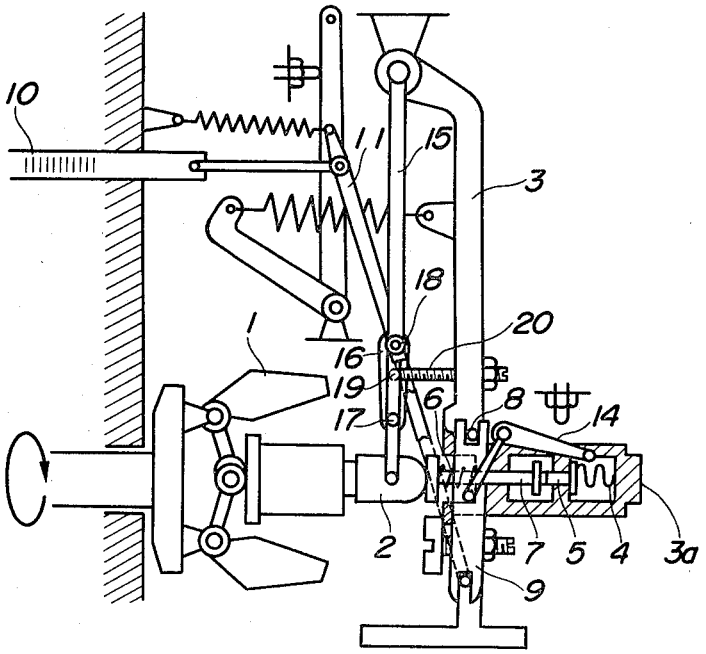
FIG.3 PRIOR ART
FIG. 3 is a view similar to FIG. 1, illustrating the centrifugal governor of FIG. 1 in operating position at cruising operation.

Then, the control lever 14 is rotated counterclockwise, i.e., in the fuel quantity increasing direction to a position shown in FIG. 3. The supporting lever 9 is accordingly counterclockwise rotated about the pin 8 to cause corresponding counterclockwise rotation of the floating lever 11 about the pin 18 to displace the control rack 10 in the fuel quantity increasing direction (in the leftward direction). Thus, the engine increases in speed into normally operating or cruising operation. As the engine speed thus increases, the flyweights 1 are radially outwardly displaced to have their centrifugal force increased. When the centrifugal force of the flyweights 1 surpasses the setting load of the idling spring 6, the shifter 2 is rightwardly moved to urgingly displace the rod 7 rightward against the force of the idling spring 6 into urging contact with the rod 5 pushed by adaptation spring 4. The above rightward movement of the shifter 2 also causes corresponding rightward displacement of the guide lever 15 so that the adjusting threaded member 20 mounted on the tension lever 3 has its tip brought into urging contact with the pin 19 on the fuel quantity increasing lever 16.

Figure 4:
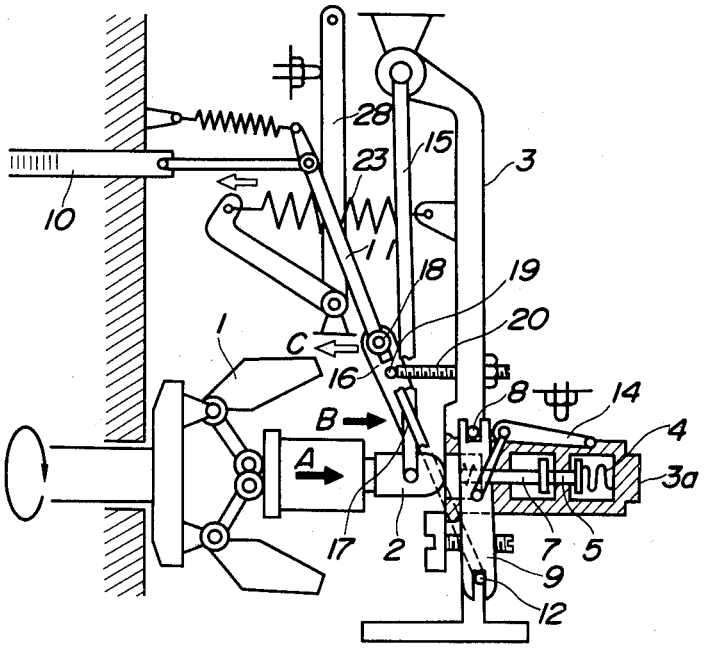
FIG. 4 PRIOR ART
FIG. 4 is a view similar to FIG. 1, illustrating the centrifugal governor of FIG. 1 in operating position when the adaptation mechanism is operative.

With a further increase in the engine rpm, the centrifugal force of the flyweights 1 surpasses the resultant force of the adaptation spring 4 and the idling spring 6, so that the shifter 2 is further moved in the rightward direction as indicated by the arrow A in FIG. 4, to cause contraction of the adaptation spring 4 via the rods 7, 5. The above movement of the shifter 2 also causes corresponding movement of the guide lever 15 in the rightward direction as indicated by the arrow B in FIG. 4. However, the fuel quantity increasing lever 16 is prohibited from rightward movement, which is then in urging contact with the adjusting threaded member 20 via the pin 19. As a consequence, the fuel quantity increasing lever 16, which is engaged at its one end by the guide lever 15 via the pin 17, is counterclockwise rotated about the pin 19 as the guide lever 15 is rightwardly moved, to displace the upper half portion of the floating lever 11 in the leftward direction as indicated by the arrow C via the pin 18 so that the control rack 10 is displaced in the fuel quantity increasing direction. In this manner, the adaptation mechanism operates to obtain an increase in the fuel injection quantity in the medium and high engine speed ranges, which is formed by the adaptation spring 4, the supporting lever 9, the fuel quantity increasing lever 16, the adjusting threaded member 20, etc. Then, when the engine speed further increases up to a preset governing starting speed determined by the position of the lever 28, the centrifugal force of the flyweights 1 surpasses the setting load of the control spring 23 so that the shifter 2 urgingly displaces the tension lever 3 rightward to cause displacement of the control rack 10 in the rightward or fuel quantity decreasing direction via the guide lever 15 and the floating lever 11, thus carrying out a governing action.

Figure 5:
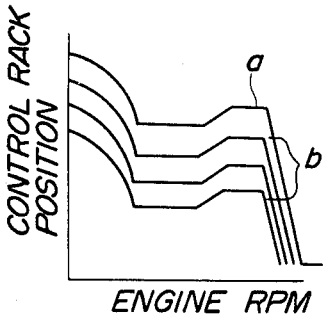
FIG.5 PRIOR ART
FIG. 5 is a graph showing the operating characteristic of the centrifugal governor illustrated in FIGS. 1 through 4.

According to the conventional centrifugal governor equipped with the adaptation mechanism described above, the adjusting threaded member 20 is held stationary at a preset position, and it depends upon the positions of the supporting lever 9 and the guide lever 15 corresponding to the position of the shifter 2 whether or not the adjusting threaded member 20 is in urging contact with the fuel quantity increasing lever 16, as previously mentioned. Therefore, as shown in FIG. 5 when the engine is in a medium or high speed range, the adaptation mechanism is actuated to increase the fuel injection quantity not only at full load of the engine (indicated by the curve a) but also at partial load of the engine (indicated by the curve b), bringing about the problems previously mentioned.

Figure 6:
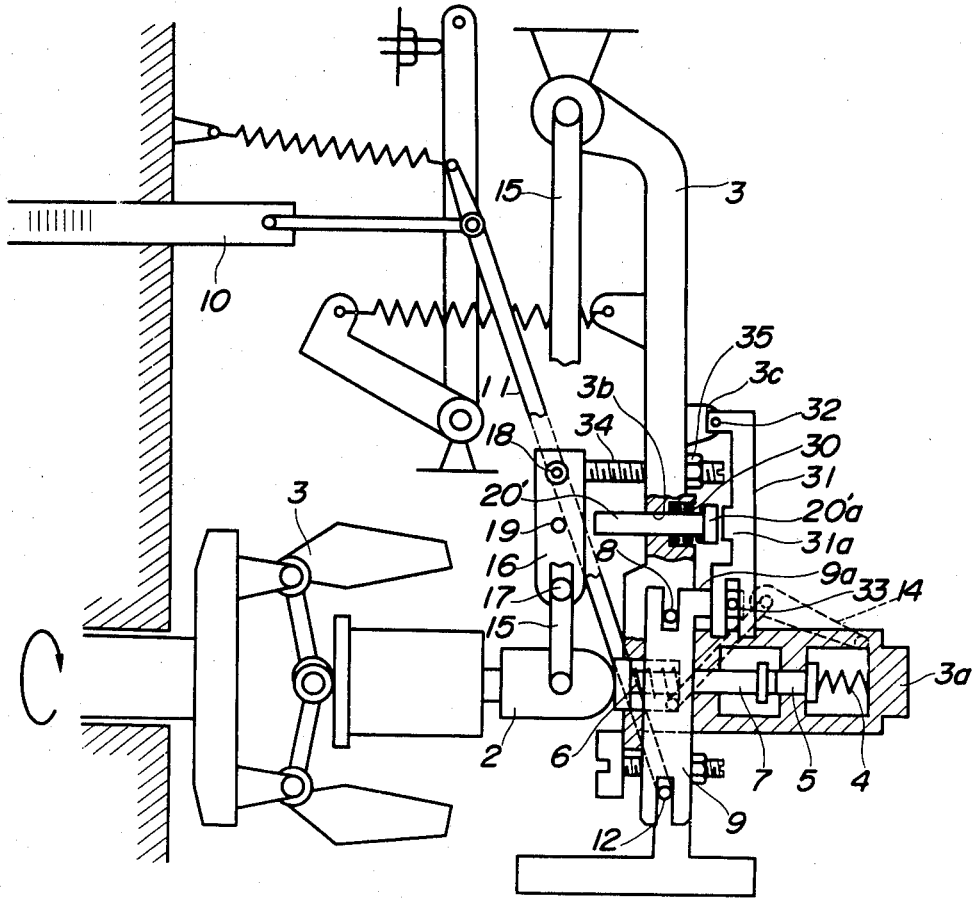
FIG. 6 is a view, partly in section, illustrating a centrifugal governor according to an embodiment of the invention.

Referring next to FIG. 6, there is illustrated an embodiment of the present invention. In FIG. 6, parts or elements corresponding to those in FIGS. 1 through 4 are designated by identical or similar reference numerals.

In FIG. 6, reference numeral 20' designates an adjusting member which corresponds to the adjusting threaded member 20 shown in FIGS. 1 through 4, but is not threaded over its periphery and fitted through a through bore **3*b* formed through the tension lever 3 for free sliding movement relative to the lever 3, as distinct from the threaded member 20. The through bore 3*b* has an enlarged half portion opening in a side surface of the tension lever 3 remote from the fuel quantity increasing lever 16. Received in the enlarged half portion of the through bore 3*b* is a coil spring 30 which has one end urging the inner end face of an enlarged end portion 20'*a* of the adjusting member 20' to bias the adjusting member 20' away from the fuel quantity increasing lever 16. An urging member 31 is provided which has a central protuberance 31*a* disposed for urging contact with the enlarged end portion 20'*a*. This member 31 has one end pivotally coupled to a lug 3*c* formed on the tension lever 3 by means of a pin 32 secured on the lug 3*c*, and has another opposite end bifurcated in which is loosely engaged a protuberance 9*a* extending integrally from the end of the supporting lever 9 engaging the tension lever 3, by means of a pin 33 secured on the protuberance 9*a*. The tension lever 3 carries a bolt-like threaded member 34 penetrating therethrough and held stationary by means of a nut 35. The threaded member 34 has one end disposed for contact with a pin 18 secured on the fuel quantity increasing lever 16. The threaded member 34 is adapted to come into urging contact with the pin 18 on the lever 16 when the fuel quantity increasing lever 16 is displaced rightward due to rightward movement of the shifter 2 and the guide lever 15 but before the adaptation spring 4 starts to be contracted, when the engine speed exceeds a predetermined value, that is, when the engine comes into a medium or high speed range where an increased fuel injection quantity is obtained due to the action of the adaptation mechanism. When the threaded member 34 is in urging contact with the fuel quantity increasing lever 16, the pin 18, which forms the pivotal fulcrum of the lever 16, is not changed in position even when the lever 16 is rotated, thus prohibiting displacement of the floating lever 11** in the fuel quantity decreasing direction.

Incidentally, in FIG. 6 the other parts or elements are arranged and constructed in an identical manner with corresponding ones in FIGS. 1 through 4, description of which is therefore omitted here.

With the above arrangement, at engine partial load in medium and high engine speed ranges, the supporting lever 9 is set at an angular position illustrated e.g. in FIG. 6, depending upon the angular position of the control lever 14, while the urging member 31 is rightwardly biased, depending upon the above position of the supporting lever 9, with its central protuberance **31*a* positioned off the enlarged end portion 20'*a* of the adjusting threaded member 20'. Accordingly, the adjusting member 20' is rightwardly biased by the spring 30 with its left end positioned off the pin 19 on the fuel quantity increasing lever 16. With the adaptation mechanism in this position, as the engine speed increases, the shifter 2 is moved rightward due to the centrifugal force of the flyweights 1 to cause contraction of the adaptation spring 4 and also rightward displacement of the guide lever 15. However, since the fuel quantity increasing lever 16 is positioned off the adjusting member 20' on this occasion, it does not counterclockwise rotate about the pin 19, so that there occurs no increase in the injection quantity. Further, since the threaded member 34 is then in urging contact with the pin 18 on the fuel quantity increasing lever 16, the lever 16 is never displaced in the rightward direction in spite of the displacement of the guide lever 15** in the same direction, and is held at the illustrated position.

On the other hand, at engine full load in the medium and high engine speed ranges, the supporting lever 9 is counterclockwise rotated about the fulcrum 8 from the position illustrated in FIG. 6 by means of the control lever 14 and set to its full load position. At the same time, the urging mmber 31 is urged via the pin 33 by the supporting lever 9 being rotated, into a leftward position with its central protuberance **31*a* urgingly displacing the enlarged end portion 20'*a* of the adjusting member 20' against the force of the spring 30 until the left end of the member 20' comes into urging contact with the pin 19 on the fuel quantity increasing lever 16. When an increase occurs in the engine speed in this state, the shiter 2 is rightwardly displaced due to the increased centrifugal force of the flyweights 1 to cause contraction of the adaptation spring 4 as well as rightward displacement of the guide lever 15. On this occasion, the fuel quantity increasing lever 16 is prohibited from corresponding righward displacement by the adjusting member 20' so that it is rotated counterclockwise about the pin 19** to cause an increase in the fuel injection quantity.

Figure 7:
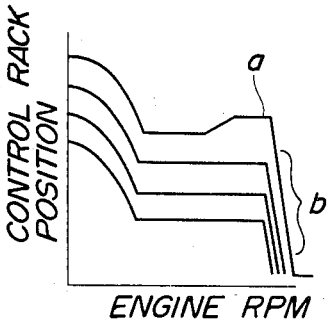
FIG. 7 is a graph showing the operating characteristic of the centrifugal governor according to the present invention.

By virtue of the above arrangement of the invention, as shown in FIG. 7, which shows an injection quantity characteristic in terms of control rack position, at engine full load, an increase in the fuel injection quantity is available in medium and high engine speed ranges as indicated by the curve a due to the action of the adaptation mechanism according to the invention, whereas at partial load, an injection quantity characteristic as indicated by the linear curves b is available in the same ranges.

At partial load, the bolt-like threaded member 34 is positioned in urging contact with the fuel quantity increasing lever 16 to hold the same at a constant position as previously mentioned, the control rack 10 is held at constant positions in the medium and high engine speed ranges as indicated by the curves b in FIG. 7, with no decrease in the injection quantity in the same ranges, thus permitting stable control of the engine speed.

While a preferred embodiment has been described, variations thereto will occur to those skilled in the art within the scope of the present inventive concepts which are delineated by the following claims.

What is claimed is:

1. In a centrifugal governor for combination with an internal combustion engine, including: flyweights radially displaceable in response to the rotational speed of said engine; a shifter movable in response to radial displacement of said flyweights; a tension lever having one end pivotally supported by a stationary shaft and another free end disposed for urging contact with said shifter; an adaptation spring disposed for counteracting movement of said shifter caused by radially outward displacement of said flyweights; a control spring arranged for applying biasing force to said tension lever in a direction counteracting radially outward displacement of said flyweights; a guide lever connected between said one end of said tension lever and said shifter; a floating lever having one end engaging a control rack; a supporting lever having one end engaging said another free end of said tension lever and another end engaging another end of said floating lever, said supporting lever being angularly displaceable about said one end thereof; a fuel quantity increasing lever having one end engaging said guide lever and another end engaging an intermediate portion of said floating lever; and an adjusting member carried by said tension lever, said adjusting member having one end disposed for urging contact with an intermediate portion of said fuel quantity increasing lever; wherein when the rotational speed of said engine exceeds a predetermined value, said adjusting member comes into urging contact with said fuel quantity increasing lever as said shifter is moved in response to radially outward displacement of said flyweights, further movement of said shifter causing contraction of said adaptation spring whereby said fuel quantity increasing lever is angularly displaced about said intermediate portion thereof to cause said floating lever to displace said control rack in a fuel quantity increasing direction thereof; the improvement comprising means responsive to angular displacement of said supporting lever to displace said adjusting member relative to said fuel quantity increasing lever, said displacing means being adapted to bring said adjusting member into urging contact with said fuel quantity increasing lever when the rotational speed of said engine exceeds a predetermined value at full load operation of said engine, whereby contraction of said adaptation spring causes angular displacement of said fuel quantity increasing lever for increasing fuel injection quantity.

2. The centrifugal governor as claimed in claim 1, wherein said adjusting member is freely displaceable relative to said tension lever, said displacing means comprising an urging member having one end thereof pivotally coupled to said tension lever, another end thereof engaging said one end of said supporting lever engaging said tension lever, and an intermediate portion thereof disposed for urging contact with said adjusting member, said urging member being angularly displaceable about said one end thereof in unison with angular displacement of said supporting lever to displace said adjusting member relative to said fuel quantity increasing lever.

3. The centrifugal governor as claimed in claim 2, comprisimg a spring urging said adjusting member in a direction away from said fuel quantity increasing lever, and wherein said urging member of said displacing means is angularly displaceable about said one end thereof in unison with angular displacement of said supporting lever to urge said adjusting member against the force of said adjusting member urging spring to displace same toward said fuel quantity increasing lever.

4. The centrifugal governor as claimed in claim 2 or claim 3, wherein said urging member of said displacing means has another end thereof bifurcated, said bifurcated end loosely engaging said one end of said supporting lever via a pin secured on the same end.

5. The centrifugal governor as claimed in claim 1, further comprising stopper means disposed for urging contact with said fuel quantity increasing lever when the rotational speed of said engine exceeds said predetermined value, said stopper means being adapted to prohibit angular displacement of said fuel quantity increasing lever in a fuel quantity decreasing direction thereof which is caused by contraction of said adaptation spring when said adjusting member is positioned off said fuel quantity increasing lever.

6. The centrifugal governor as claimed in claim 5, wherein said stopper means comprises a threaded member threadedly engaging said tension lever, said threaded member having one end thereof disposed for urging contact with said fuel quantity increasing lever.

7. The centrifugal governor as claimed in claim 1, wherein said supporting lever is manually angularly displaceable about said one end thereof.

* * * * *